US008967262B2

(12) United States Patent
Jo

(10) Patent No.: US 8,967,262 B2
(45) Date of Patent: Mar. 3, 2015

(54) METHOD FOR DETERMINING FRACTURE SPACING AND WELL FRACTURING USING THE METHOD

(75) Inventor: Hyunil Jo, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 330 days.

(21) Appl. No.: 13/595,634

(22) Filed: Aug. 27, 2012

(65) Prior Publication Data

US 2013/0062054 A1 Mar. 14, 2013

Related U.S. Application Data

(60) Provisional application No. 61/534,702, filed on Sep. 14, 2011.

(51) Int. Cl.
*E21B 43/26* (2006.01)

(52) U.S. Cl.
CPC ..... *E21B 43/26* (2013.01)
USPC ..... 166/308.1

(58) Field of Classification Search
USPC ..... 166/250.01, 250.1, 308.1
See application file for complete search history.

(56) References Cited

U.S. PATENT DOCUMENTS

2007/0272407 A1* 11/2007 Lehman et al. ..... 166/250.1
2011/0017458 A1 1/2011 East et al.
2012/0325462 A1* 12/2012 Roussel et al. ..... 166/250.1

FOREIGN PATENT DOCUMENTS

WO WO2011107732 9/2011

OTHER PUBLICATIONS

International Search Report & Written Opinion mailed Aug. 23, 2013 issued in PCT/US2012/052668.
Nicolas Roussel et al., "Optimizing Fracture Spacing and Sequencing in Horizontal-Well Fracturing" SPE Production & Operations, vol. 26, No. 2, May 1, 2011.
Mohamed Soliman et al., "Fracturing Design Aimed at Enhancing Fracture Complexity" Proceedings of SPE Europec/Eage Annual Conference and Exhibition, Jan. 1, 2010.

* cited by examiner

*Primary Examiner* — Brad Harcourt
(74) *Attorney, Agent, or Firm* — Parsons Behle & Latimer

(57) ABSTRACT

A method for determining the fracture spacing for a first set of fractures of a wellbore. A first fracture dimension is chosen from the smaller of the length or height of a first fracture and an expected second fracture dimension is chosen from the smaller of the expected length or expected height of a second fracture to be formed. An approximate position of the second fracture is determined from a percentage of the average of the first fracture dimension and the second fracture dimension. An approximate position of a third fracture is determined so that ratio of the distances from the first fracture and the second fracture are about equal to a ratio of the first fracture dimension and the second fracture dimension. The well may then be fractured at the approximate position of the second fracture and may be fractured at the approximate position of the third fracture.

22 Claims, 2 Drawing Sheets

METHOD FOR DETERMINING FRACTURE SPACING AND WELL FRACTURING USING THE METHOD

FIELD OF THE DISCLOSURE

The present disclosure relates generally to a method for determining fracture intervals for hydrocarbon fluid producing wells.

BACKGROUND

The flow of oil and/or gas from a subterranean formation to a well bore depends on various factors. For example, hydrocarbon-producing wells are often stimulated using hydraulic fracturing techniques. As is well understood in the art, fracturing techniques involve introducing a fluid at pressures high enough to fracture the formation. Such fracturing techniques can increase hydrocarbon production from the wellbore.

In some instances, the fracturing can result in an interconnected network of fractures. Creating complex fracture networks by hydraulic fracturing is an efficient way to produce hydrocarbon fluids from a low permeability formation such as shale gas reservoir. Several factors can affect the making of complex fracture networks. One significant factor is in-situ stress anisotropy (i.e., the maximum in-situ horizontal stress less the minimum in-situ horizontal stress at the normal fault stress regime). As shown by U.S. Patent Application Publication No. 2011/0017458, to Loyd E. East et al., low in-situ stress anisotropy increases the chance of creating complex fracture networks with hydraulic fracturing.

While techniques for forming complex fracture networks are known, improved methods for forming complex fracture networks would be considered a valuable advancement the art.

SUMMARY

An embodiment of the present disclosure is directed to a method for determining fracture spacing for a wellbore to induce complex fracture networks. The method comprising providing a first fracture dimension, $D_{F1}$, chosen from the smallest of the length or height of a first fracture. An expected second fracture dimension, $D_{F2}$, is chosen from the smallest of the expected length or expected height of a second fracture to be formed. An approximate position of the second fracture to be formed is determined, the approximate position being a distance, $D_{1-2}$, along the wellbore from the first fracture, where $D_{1-2}$ is a percentage of the average of $D_{F1}$ and $D_{F2}$. An approximate position of a third fracture which is formed between the first fracture and the second fracture to induce complex fracture networks is determined, the approximate position of the third fracture being a distance, $D_{1-3}$, along the wellbore from the first fracture and an approximate distance $D_{2-3}$ along the wellbore from the second fracture, so that the ratio of $D_{1-3}$:$D_{2-3}$ is about equal to the ratio of $D_{F1}$:$D_{F2}$. The approximate position of the second fracture is used as input in a first numerical simulation to calculate a desired second fracture position. The wellbore is fractured to form the second fracture at about the desired second fracture position. The approximate position of the third fracture is used as input in a second numerical simulation to calculate a desired third fracture position. The wellbore is fractured to form the third fracture, which can create complex fracture networks, at about the desired third fracture position.

Another embodiment of the present disclosure is directed to a fractured wellbore. The fractured wellbore comprises a first fracture having a fracture dimension, $D_{F1}$, chosen from the smallest of the length or height of the first fracture; and a second fracture having an expected second fracture dimension, $D_{F2}$, chosen from the smallest of the expected length or expected height of a second fracture. The distance between the first fracture and the second fracture is determined as a percentage of the arithmetical average of $D_{F1}$ and $D_{F2}$. A third fracture is positioned between the first fracture and the second fracture. The third fracture is a distance, $D_{1-3}$, along the wellbore from the first fracture and a distance, $D_{2-3}$, along the wellbore from the second fracture, so that the ratio of $D_{1-3}$:$D_{2-3}$ is approximately equal to the ratio of $D_{F1}$:$D_{F2}$.

Figure 1:
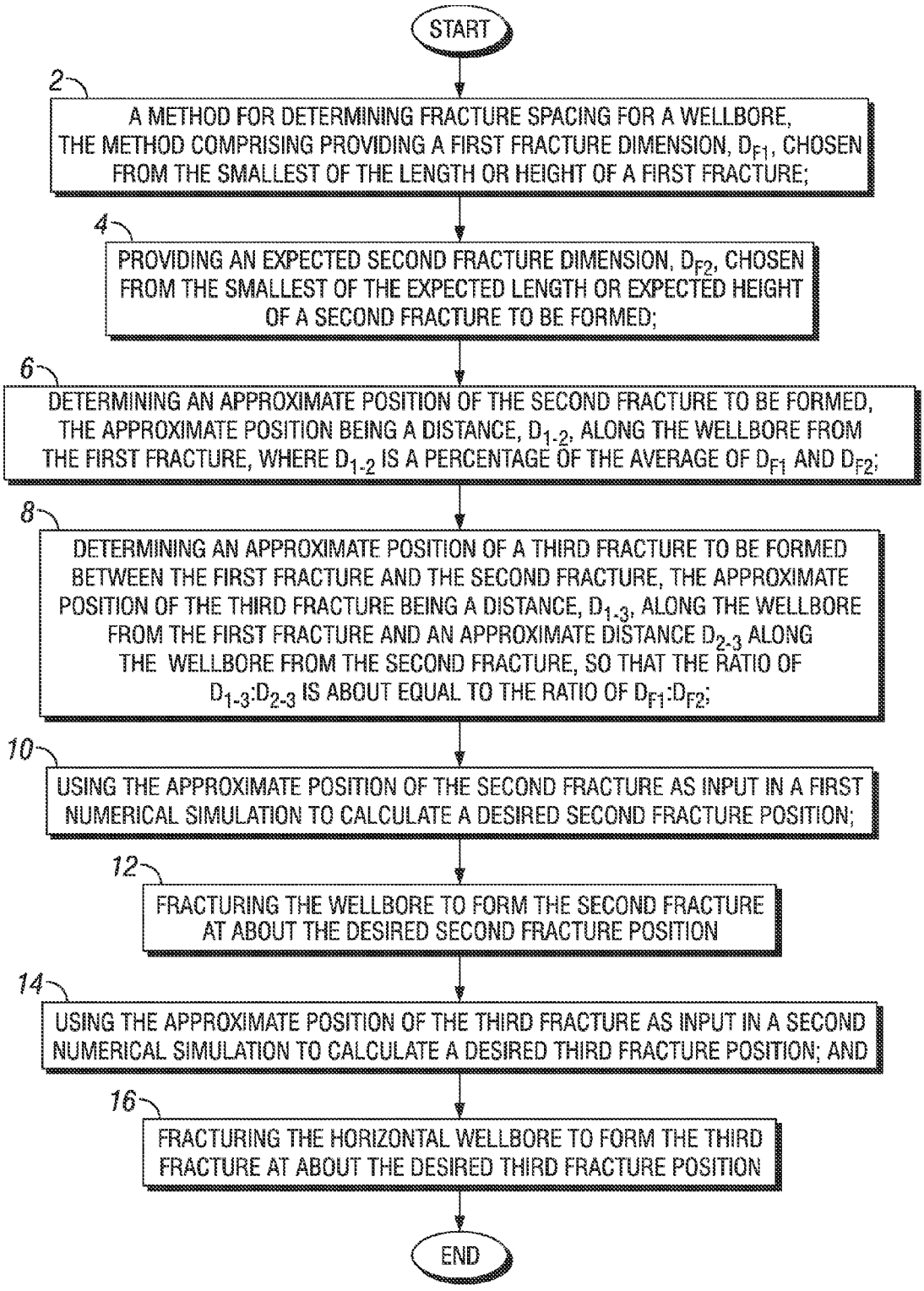
FIG. 1 illustrates a flow diagram of a method for determining fracturing intervals in a fracture process, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

The present disclosure sets forth a method of determining improved fracture spacing that allows stress induced by the net pressure of fractures to reduce in-situ stress anisotropy and thereby improve complex fracture networks at a low permeability formation. Regardless of the net pressure value of each fracture, the method can generally determine an improved fracture space.

FIG. 1 illustrates a method for determining fracture intervals for a well, according to an embodiment of the present disclosure. The method will also be described with reference to FIG. 2, which illustrates a schematic view of well 100 comprising a wellbore 102 that has been fractured using the methods of the present disclosure. The wellbore 102 can be curved or can be at any angle relative to the surface, such as a vertical wellbore, a horizontal wellbore or a wellbore formed at any other angle relative to the surface. In an embodiment, the wellbore is an approximately horizontal wellbore.

Figure 2:
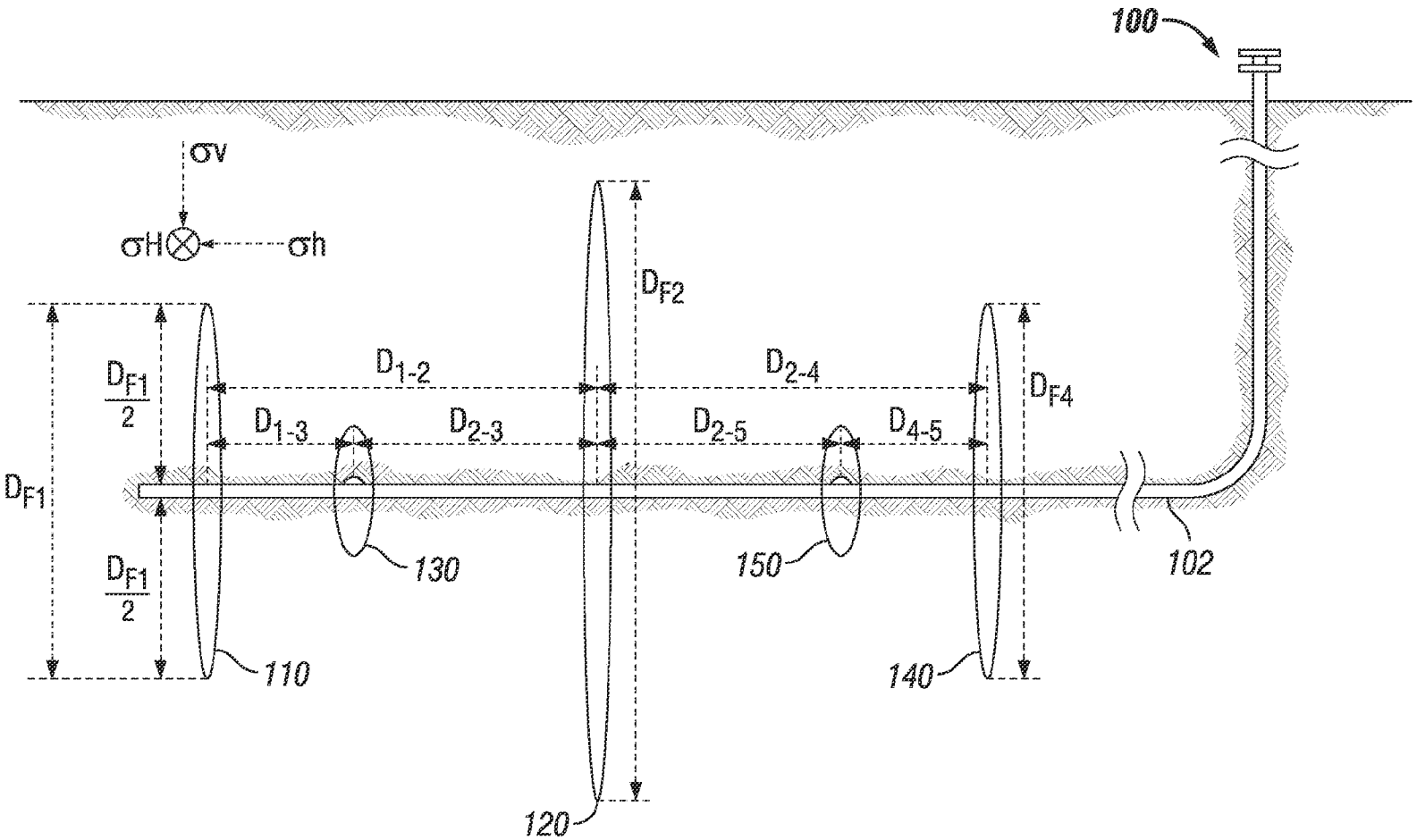
FIG. 2 illustrates a schematic side view of a wellbore showing fracture intervals, according to an embodiment of the present disclosure.

As shown at block 2 of FIG. 1, the method comprises providing a dimension, $D_{F1}$, of a first fracture. For reasons that will be described in greater detail below, $D_{F1}$ can be chosen to be either the length or height of the fracture, whichever is smallest. As illustrated in FIG. 2, $D_{F1}$ is shown as the height dimension of fracture 110. In an embodiment, the first fracture is formed, and then the size of $D_{F1}$ can be estimated based on, for example, microseismic measurements or any other suitable technique for measuring fracture dimensions. Alternatively, $D_{F1}$ can be provided based on the proposed dimensions set forth in the fracturing schedule, or in any other suitable manner. Fracture 110 can be formed by any suitable technique.

As shown at block 4 of FIG. 1, the method comprises providing an expected dimension, $D_{F2}$, of a second fracture 120. $D_{F2}$ can be chosen to be either the length or height of the second fracture, whichever is smallest. As illustrated in FIG. 2, $D_{F2}$ is shown as the height dimension of fracture 120.

Alternatively, the same parameter, either length or height, as was used for $D_{F1}$ can also be used for $D_{F2}$, regardless of which of the length or height is smallest for the second fracture.

For purposes of determining the approximate position of the second fracture 120, a value for $D_{F2}$ can be predicted in any suitable manner. For example, $D_{F2}$ can be provided based on the proposed dimensions set forth in the fracturing schedule.

As shown in FIG. 2, it can be assumed for purposes of the calculations performed herein that ½ of the height of each of the fractures, including $D_{F1}$, $D_{F2}$, and the other fractures shown in FIG. 2, are formed on either side of the wellbore 102. One of ordinary skill in the art would readily understand that in actuality the fracture is not likely to be so symmetrically formed.

Before forming the second fracture 120, a desired interval, $D_{1-2}$, between first fracture 110 and second fracture 120 can be determined, as shown at block 6 of FIG. 1. $D_{1-2}$ can be estimated based on a percentage of the arithmetical average of $D_{F1}$ and $D_{F2}$. For example, the estimated distance between the first fracture and the second fracture can be about $0.3*(D_{F1}+D_{F2})/2$ to about $0.8*(D_{F1}+D_{F2})/2$, such as about $0.35*(D_{F1}+D_{F2})/2$ to about $0.7*(D_{F1}+D_{F2})/2$. In an embodiment, the estimated distance between the first fracture and the second fracture is about $0.6*(D_{F1}+D_{F2})/2$.

As will be discussed below, the basis for estimating a distance between the first and second fractures is based on two analytical solutions and a numerical simulation. The two analytical solutions are the 2D fracture model (semi-infinite model) and the penny-shape fracture model, both of which are generally well known in the art. From the analytical models, we can obtain the following estimate for a desired fracture space.

From the 2D fracture model (semi-infinite model), $$L_1 + L_2 = \sqrt{\frac{v}{2(3-2v)}}\,h_1 + \sqrt{\frac{v}{2(3-2v)}}\,h_2 = \frac{(h_1+h_2)}{2}\,2\sqrt{\frac{v}{2(3-2v)}} \quad \text{(Eq. 1)}$$

Where:

$L_1$ is the distance along the wellbore from the fracturing point of the first fracture to a point at which the maximum stress contrast induced by the net pressure of the first fracture occurs;

$L_2$ is the distance along the wellbore from the fracturing point of the second fracture to a point at which the maximum stress contrast induced by the net pressure of the second fracture occurs;

$h_1$ is the fracture height of the first fracture;

$h_2$ is the fracture height of the second fracture; and $\upsilon$ is the Poisson's ratio of a formation;

From the penny-shape fracture model, $$L_1 + L_2 = \frac{h_1}{2}\sqrt{\frac{(1+\upsilon)}{(5-\upsilon)}} + \frac{h_2}{2}\sqrt{\frac{(1+\upsilon)}{(5-\upsilon)}} = \frac{(h_1+h_2)}{2}\sqrt{\frac{(1+\upsilon)}{(5-\upsilon)}} \quad \text{(Eq. 2)}$$

Where:

$L_1$, $L_2$, $h_1$, $h_2$ and $\upsilon$ are the same as described above for Eq. 1;

From Eq. 1 and 2, it is observed that the optimal fracture spacing can be calculated using the arithmetical average height of the first and second fractures, or $(h_1+h_2)/2$ multiplied with a certain factor such as $$2\sqrt{\frac{v}{2(3-2v)}}$$

for the semi-infinite fracture model and $$\sqrt{\frac{(1+\upsilon)}{(5-\upsilon)}}$$

for the penny-shape fracture model. In addition, it is proved by the 3D analytical ellipsoidal crack solution that the stress induced by the net pressure of general bi-wing fractures can exist between the stress value determined by the penny-shape fracture model and the stress value determined by the semi-infinite fracture model. Also, we have $$0 \le 2\sqrt{\frac{v}{2(3-2v)}} \le 0.7071$$

and $$0.4472 \le \sqrt{\frac{(1+\upsilon)}{(5-\upsilon)}} \le 0.5774$$

with $0 \le \upsilon \le 0.5$. However, since the Poisson's ratios of most formations exist between 0.2 and 0.4, $$0.3922 \le 2\sqrt{\frac{v}{2(3-2v)}} \le 0.6030$$

and $$0.5 \le \sqrt{\frac{(1+\upsilon)}{(5-\upsilon)}} \le 0.5517.$$

Therefore, the estimated fracture space, as determined using the above models, exists between about 35% and about 70% of the arithmetical average of the first and second fracture heights (assuming fracture height is the smallest dimension chosen from the length or height of the fracture). A more detailed description of the derivation of Formulae 1 and 2 is found in the conference preceding publication by Hyunil Jo, Ph.D., Baker Hughes, SPE, entitled, "Optimizing Fracture Spacing to Induce Complex Fractures in a Hydraulically Fractured Horizontal Wellbore," SPE America's Unconventional Resources Conference, Pittsburg, Pa. (Jun. 5-7, 2012), publication No. SPE-154930 (hereinafter referred to as "SPE-154930-PP") which is hereby incorporated by reference in its entirety.

The above analytical models assume that the first and second fractures are straight lines, or that they are parallel to each other. The numerical simulation, on the other hand, was developed by using the Boundary Element Method ("BEM")

in order to consider curved fractures' effect on the stress contrast induced by net pressure. The BEM simulation has the ability to consider the effect of stress interaction between the first fracture which has propagated and the second fracture which is propagating.

The results of the BEM simulation show that the second fracture is generally curved, even if its curvature depends on various factors such as fracture spacing and net pressure. While the exact reasons why the second fracture is curved are not clear, it might be caused by the shear stress distribution change induced by the interaction between the first and second fractures while the second fracture propagates. Simulations show that the amount of curvature appears to be dependent on net pressure and fracture spacing (e.g., the amount of space between the first and second fracture can affect the curvature of the second fracture). For example, as discussed in greater detail in SPE-154930-PP, the fracture may have an attractive shape when the fracture space is within a certain value. However, beyond that value, the second fracture may have a repulsive shape. For example, a second fracture spaced 200 feet from the first fracture may have the largest repulsive shape, which decreases as the spacing decreases. At a certain spacing, such as a 70 feet, the second fracture may no longer have a repulsive shape, but instead be parallel in regards to the first fracture. At a spacing of less than 60 feet, the second fracture may have an attractive shape. The shear stress distribution change induced by the interaction between the first and second fractures while the second fracture propagates may cause the shape of the fracture to be attractive, repulsive, or parallel.

The curvature of the second fracture can affect the stress contrast compared to a situation in which a parallel fracture is formed. It appears from the numerical simulation that the repulsive shape fractures can enhance the stress contrast induced by the fracture interaction (i.e. can reduce more in-situ stress anisotropy), while attractive shape fractures vitiate the stress contrast (i.e., can reduce less in-situ stress anisotropy). The results of these numerical simulations appear to suggest that an increased stress contrast induced by the fracture interaction can be achieved at a fracture space between the first and second fractures of about 60% of the average height of the first and second fractures. This number can generally be used to provide an initial approximation of fracture position that can be used as input for performing numerical simulations to calculate a desired position for the second fracture.

As shown at block 10 of FIG. 1, the estimated position calculated for the second fracture can be used to determine a desired second fracture position by employing numerical modeling methods. For example, simulations may be run to investigate a stress contrast value induced by net pressure for a fracture position calculated based on 60% of the average height of the first and second fractures, as well as at other possible fracture positions in the general proximity of the estimated position, such as at 40%, 45%, 50%, 55%, 65% and 70% of the average height of the first and second fractures. The resulting stress contrast values can then be compared to determine the desired position at which the fracture should be formed. The wellbore can be fractured at about the desired second fracture position, as shown at block 12 of FIG. 1.

A third fracture 130, which can create complex fracture networks, can be positioned between the first fracture 110 and the second fracture 120. As illustrated in FIG. 2, the position of the third fracture 130 is a distance, $D_{1-3}$, along the wellbore from the first fracture, and a distance $D_{2-3}$ along the wellbore from the second fracture. In an embodiment, an approximate position of the third fracture can be determined by setting the ratio of $D_{1-3}$:$D_{2-3}$ to be approximately equal to the ratio of $D_{F1}$:$D_{F2}$, as shown at block 8 of FIG. 1. For example, the ratio of $D_{1-3}$:$D_{2-3}$ can be in the range of +/−5% of the average value of the two fracture heights of $D_{F1}$ and $D_{F2}$, such as set forth in the relationship $[D_{F1}+/-(0.05)(D_{F1}+D_{F2})/2]:[D_{F2}+/-(0.05)(D_{F1}+D_{F2})/2]$.

For purposes of determining the approximate position of the third fracture 130, a predicted value for $D_{F2}$ can be employed, similarly as was the case when determining the position of the second fracture. Alternatively, the value of $D_{F2}$ that is used for determining the position of the third fracture can be obtained using other suitable techniques, such as by estimating the actual size based on microseismic measurements after the second fracture is formed, as is well known in the art.

As shown at block 14 of FIG. 1, the estimated position calculated for the third fracture can be used to determine a desired third fracture position by employing numerical modeling methods. For example, simulations may be run to investigate a stress contrast value induced by net pressure for various fracture positions at or near the approximated third fracture position. The resulting stress contrast values for the various fracture positions can then be compared to determine the desired position at which the fracture should be formed. The wellbore can be fractured at about the desired third fracture position, as shown at block 16 of FIG. 1.

Additional fractures can be formed using the techniques described herein. In general, the process discussed above for estimating and determining a desired position for fractures 120 and 130 can be repeated to form any number of additional fractures. For example, FIG. 2 illustrates a fourth fracture 140 and a fifth fracture 150 having fracture intervals determined by the methods of the present disclosure. The fifth fracture can be formed to create complex fracture networks. In an embodiment, the process of forming the fourth fracture 140 and fifth fracture 150 can be performed if the space between the first and second fractures, $D_{1-2}$, is greater than the value of $D_{F1}$.

It has been found that improved complex fracture networks result in the space between the second and fourth fractures if the space between the first and second fractures, $D_{1-2}$, is greater than the value of $D_{F1}$. This is because when this condition is met, the stress shadow effect caused by first fracture almost disappears at the space between the second and fourth fractures. The stress shadow effect between fractures is generally controlled by the smallest areal fracture dimension (i.e., fracture height or fracture length), which is often fracture height. Thus, in cases where fracture height is the smallest of the fracture height or fracture length, for example, then the methods of the present invention can provide improved results if the space between the first and second fractures is greater than the height of the first fracture.

Before forming the fourth fracture 140, a desired interval, $D_{2-4}$, between second fracture 120 and fourth fracture 140 can be determined. $D_{2-4}$ is estimated using a percentage of the average value of $D_{F2}$ and $D_{F4}$, where, $D_{F4}$, is chosen from the smallest of the expected length or expected height of the fourth fracture 140.

For example, the estimated distance between the second fracture and the fourth fracture can be about $0.3*(D_{F2}+D_{F4})/2$ to about $0.8*(D_{F2}+D_{F4})/2$, such as about $0.35*(D_{F2}+D_{F4})/2$ to about $0.7*(D_{F2}+D_{F4})/2$. In an embodiment, the estimated distance between the second fracture and the fourth fracture is about $0.6*(D_{F2}+D_{F4})/2$. The estimated distance can be confirmed or adjusted based on numerical modeling methods, which are well known in the art.

The fifth fracture 150, which can create complex fracture networks, can be positioned between the second fracture 120 and the fourth fracture 140. As illustrated in FIG. 2, the position of the fifth fracture 150 is a distance, $D_{2-5}$, along the wellbore from the second fracture, and a distance $D_{4-5}$ along the wellbore from the fourth fracture. In an embodiment, the distances $D_{2-5}$ and $D_{4-5}$ are chosen so that the ratio of $D_{2-5}$:$D_{4-5}$ is approximately equal to the ratio of $D_{F2}$:$D_{F4}$. For example, the ratio of $D_{2-5}$:$D_{4-5}$ can be in the range of +/−5% of the average value of the two fracture heights of $D_{F2}$ and $D_{F4}$, such as set forth in the relationship $[D_{F2}+/-(0.05)(D_{F2}+D_{F4})/2]:[D_{F4}+/-(0.05)(D_{F2}+D_{F4})/2]$.

For purposes of determining the position of the fifth fracture 150, a value for $D_{F4}$ can be predicted as was the case when determining the position of the fourth fracture. Alternatively, the value of $D_{F4}$ that is used for determining the position of the fifth fracture can be obtained using other suitable techniques, such as by estimating the size of $D_{F4}$ based on microseismic measurements after the fourth fracture is formed, as is well known in the art.

As mentioned above, the process of forming the fourth fracture 140 and fifth fracture 150 can be performed if the space between the first and second fractures, $D_{1-2}$, is greater than the value of $D_{F1}$. If, on the other hand, $D_{1-2}$, is less than or equal to the value of $D_{F1}$, a second set of fractures can be formed a distance greater than $D_{F2}$ from the fracture 120, instead of forming fractures 140 and 150 as described above. The second set of fractures (not shown) can be formed by repeating the process discussed above for forming fractures 110, 120 and 130.

The present disclosure will be further described with respect to the following examples, which are not meant to limit the invention, but rather to further illustrate the various embodiments.

EXAMPLES

The following example is provided for illustrative purposes only, and is not to be taken as limiting the claims of this disclosure.

Referring to FIG. 2, and assuming that $D_{F1}$, $D_{F2}$ and $D_{F4}$ are height dimensions having the following values:

$D_{F1}$=80 ft;

$D_{F2}$=190 ft;

$D_{F4}$=90 ft; and

Setting the space between the first and second fractures to 60% of the arithmetical average fracture height of the first and second fractures:

The calculated interval, $D_{1-2}$=(80+190)/2*0.6=81 ft.

The 3rd fracture is calculated to be positioned a distance $D_{1-3}$=80/(80+190)*81=24 ft from the first fracture and $D_{2-3}$=190/(80+190)*81=57 ft from the second fracture.

Because the space between the first and second fractures (81 ft) is longer than $D_{F1}$(80 ft), a similar calculation process can be performed to determine intervals for the fourth and fifth fractures. Thus, the space between the second and fourth fractures, $D_{2-4}$, can be calculated as (190+90)/2*0.6=84 ft.

The fifth fracture can be calculated as $D_{2-5}$=190/(190+90)*84=57 ft from the second fracture and $D_{4-5}$=90/(190+90)*84=27 ft from the fourth fracture.

Although various embodiments have been shown and described, the present disclosure is not so limited and will be understood to include all such modifications and variations as would be apparent to one skilled in the art.

What is claimed is:

1. A method for determining fracture spacing for a first set of fractures of a wellbore, the method comprising:

providing a first fracture dimension, $D_{F1}$, chosen from the smallest of the length or height of a first fracture;

providing an expected second fracture dimension, $D_{F2}$, chosen from the smallest of the expected length or expected height of a second fracture to be formed;

determining an approximate position of the second fracture to be formed, the approximate position being a distance, $D_{1-2}$, along the wellbore from the first fracture, where $D_{1-2}$ is a percentage of the average of $D_{F1}$ and $D_{F2}$;

determining an approximate position of a third fracture to be formed between the first fracture and the second fracture, the approximate position of the third fracture being a distance, $D_{1-3}$, along the wellbore from the first fracture and an approximate distance $D_{2-3}$ along the wellbore from the second fracture, so that the ratio of $D_{1-3}$:$D_{2-3}$ is about equal to the ratio of $D_{F1}$:$D_{F2}$;

using the approximate position of the second fracture as input in a first numerical simulation to calculate a desired second fracture position;

fracturing the wellbore to form the second fracture at about the desired second fracture position;

using the approximate position of the third fracture as input in a second numerical simulation to calculate a desired third fracture position; and fracturing the wellbore to form the third fracture at about the desired third fracture position.

2. The method of claim 1, further comprising fracturing to form the first fracture prior to providing the first fracture dimension, $D_{F1}$, wherein $D_{F1}$ is estimated based on microseismic measurements of the first fracture.

3. The method of claim 1, further comprising forming the second fracture after determining $D_{1-2}$.

4. The method of claim 1, wherein the distance between the first fracture and the second fracture ranges from about $0.3*(D_{F1}+D_{F2})/2$ to about $0.8*(D_{F1}+D_{F2})/2$.

5. The method of claim 1, wherein the distance between the first fracture and the second fracture is about $0.6*(D_{F1}+D_{F2})/2$.

6. The method of claim 1, wherein the distance between the first fracture and the second fracture is greater than $D_{F1}$.

7. The method of claim 6, further comprising determining a distance between a fourth fracture and the second fracture, the fourth fracture having a fourth fracture dimension, $D_{F4}$, chosen from the smallest of the length or height of the fourth fracture, wherein the distance between the fourth fracture and the second fracture is at least $0.3*(D_{F2}+D_{F4})/2$ to about $0.8*(D_{F2}+D_{F4})/2$.

8. The method of claim 7, wherein the distance between the fourth fracture and the second fracture is about $0.6*(D_{F2}+D_{F4})/2$.

9. The method of claim 7, further comprising calculating a position of a fifth fracture to be formed between the second fracture and the fourth fracture, the position of the fifth fracture being a distance, $D_{2-5}$, along the wellbore from the second fracture and a distance $D_{4-5}$ along the wellbore from the fourth fracture, so that the ratio of $D_{2-5}$:$D_{4-5}$ is approximately equal to the ratio of $D_{F2}$:$D_{F4}$.

10. The method of claim 1, wherein the first simulation takes into account a curved effect of the second fracture on the stress contrast induced by the net pressure of the first and second fracture.

11. The method of claim 1, wherein the approximate position of the third fracture is determined after fracturing the wellbore at about the desired second fracture position.

12. The method of claim 1, wherein the wellbore is a horizontal portion of a well.

13. The method of claim 1, wherein if the distance between the first fracture and the second fracture is less than or equal to $D_{F1}$, a second set of fractures is formed a distance greater than $D_{F2}$ from the second fracture.

14. The method of claim 13, wherein forming the second set of fractures comprises repeating the method of claim 1.

15. A fractured wellbore, comprising:

a first fracture having a fracture dimension, $D_{F1}$, chosen from the smallest of the length or height of the first fracture;

a second fracture having an expected second fracture dimension, $D_{F2}$, chosen from the smallest of the expected length or expected height of a second fracture, wherein a distance between the first fracture and the second fracture is determined as percentage of the arithmetical average of $D_{F1}$ and $D_{F2}$;

a third fracture between the first fracture and the second fracture, the third fracture being a distance, $D_{1-3}$, along the wellbore from the first fracture and a distance, $D_{2-3}$, along the wellbore from the second fracture, so that the ratio of $D_{1-3}$:$D_{2-3}$ is approximately equal to the ratio of $D_{F1}$:$D_{F2}$.

16. The wellbore of claim 15, wherein the wellbore is a horizontal portion of a well.

17. The wellbore of claim 15, wherein the ratio of $D_{1-3}$:$D_{2-3}$ is within the range of $[D_{F1}+/-(0.05)(D_{F1}+D_{F2})/2]:[D_{F2}+/-(0.05)(D_{F1}+D_{F2})/2]$.

18. The wellbore of claim 15, wherein the distance between the first fracture and the second fracture is greater than $D_{F1}$.

19. The wellbore of claim 18, further comprising determining a distance between a fourth fracture and the second fracture, the fourth fracture having a fourth fracture dimension, $D_{F4}$, chosen from the smallest of the length or height of the fourth fracture, wherein the distance between the fourth fracture and the second fracture is at least $0.3*(D_{F2}+D_{F4})/2$ to about $0.8*(D_{F2}+D_{F4})/2$.

20. The wellbore of claim 19, wherein the distance between the fourth fracture and the second fracture is about $0.6*(D_{F2}+D_{F4})/2$.

21. The wellbore of claim 19, further comprising calculating a position of a fifth fracture to be formed between the second fracture and the fourth fracture, the position of the fifth fracture being a distance, $D_{2-5}$, along the wellbore from the second fracture and a distance $D_{4-5}$ along the wellbore from the fourth fracture, so that the ratio of $D_{2-5}$:$D_{4-5}$ is approximately equal to the ratio of $D_{F2}$:$D_{F4}$.

22. The wellbore of claim 21, wherein the ratio of $D_{2-5}$:$D_{4-5}$ is within the range of $[D_{F2}+/-(0.05)(D_{F2}+D_{F4})/2]:[D_{F4}+/-(0.05)(D_{F2}+D_{F4})/2]$.

* * * * *